United States Patent [19]

Levinsohn et al.

[11] 4,141,097

[45] Feb. 27, 1979

[54] DUST RUFFLE

[76] Inventors: Ronald Levinsohn; Martin Baron, both of 320 Fifth Ave., New York, N.Y. 10001

[21] Appl. No.: 852,544

[22] Filed: Nov. 17, 1977

[51] Int. Cl.[2] ..... A47C 21/00

[52] U.S. Cl. ..... 5/333; 5/334 C

[58] Field of Search ..... 5/333–335, 5/362

[56] References Cited

U.S. PATENT DOCUMENTS

| | | | |
|---|---|---|---|
| 2,763,875 | 9/1956 | Pioutkowski | 5/333 |
| 3,600,728 | 8/1971 | Kinzel | 5/362 |
| 3,999,233 | 12/1976 | Morris | 5/333 |

*Primary Examiner*—Casmir A. Nunberg
*Attorney, Agent, or Firm*—Robert W. Fiddler

[57] ABSTRACT

A dust ruffle for use over a bed frame to provide a desired fabric enclosure for the lower portion of a bed. The dust ruffle is formed with a top portion overlying the top of the bed frame, and preferably arranged over the conventionally employed box spring. A vertically extending portion comprising a skirt or flounce is connected to the top portion, and this skirt or flounce extends down to a point touching, or in close proximity, to the floor. The skirt or flounce extends along two sides, and the foot of the bed. The vertically extending portion of the dust ruffle further comprises a retaining panel or flap secured along the head end of the top portion and is dimensioned to securely engage the rear vertical surface of the bed frame or box spring. An elasticized seam (elastic in a direction transverse to the seam) is formed by employing an elastic thread and/or a shirred stitch to join the abutting edges of the vertically extending portions at least along the points where they contact the bed frame and/or box spring to provide an elasticized fit of the dust ruffle on the bed in connection with which it is used.

5 Claims, 2 Drawing Figures

DUST RUFFLE

BACKGROUND OF THE INVENTION

This invention relates to the art of dust ruffles, namely, those bed coverings designed to cover the lower portions of a bed to minimize the flow of dust laden air under the bed, and to provide a decorative appearance for the bedstead.

A variety of dust ruffles have been evolved over the years designed to accomplish the desired function of minimizing air flow so as to minimize dust collection beneath the bed, and further to provide a decorative appearance. These previously evolved dust ruffles are generally provided with a skirt or flounce extending vertically from a top portion overlying the bed frame or box spring, with the top portion normally sandwiches between the mattress and the spring portion of the bed, which is generally a box spring. As a result of the normal movement of a sleeper using the bed, the slight shiftings of the mattress beneath which a top portion of the dust ruffle is positioned generally results in a disturbance of the desired orientation of the dust ruffle necessitating awkward movement and repositioning of the ruffle by the homemaker making up the bed.

SUMMARY OF THE INVENTION

It is with the above considerations in mind that the present improved dust ruffle has been evolved providing a dust ruffle which is relatively securely anchored with respect to the bed requiring no repositioning as a result of normal use of the bed. Further, in accordance with one embodiment of the invention, a reduction of the normally required fabric conventionally employed in making up previously evolved dust ruffles is attained.

It is among the primary objects of this invention to provide an improved dust ruffle which will eliminate the need for refitting of the ruffle as a result of normal usage of the bed.

Another object of the invention is to provide an improved dust ruffle which will minimize the required amounts of material necessary to produce the dust ruffle.

These and other objects of the invention which will become hereafter apparent are achieved by forming a dust ruffle with a top portion dimensioned to lie over the top of the bed frame. Two forms of top portion may be employed. In one form, the top portion is formed of sheet material, usually fabric, dimensioned to correspond to the horizontal surface dimension of the bed in connection with which the dust ruffle is to be employed. In another form of top, the top portion comprises a series of strips dimensioned to extend along the sides, top and head of the bed and of a width such as to extend from the edges, top and head of the bed, towards the center thereof, a distance sufficient to permit secure sandwiching of the top portion between the mattress and a spring or box spring of the bed. Strips having a width of between 3" and 12" are eminently suitable. The dust ruffle is formed with vertically extending portions which comprise a skirt or flounce extending along the sides and foot of the bed, with the skirt extending to the floor or a point in close proximity to the floor, depending on the tastes of the user of the dust ruffle. In one form of the invention, the skirt is secured directly to the top portion. In another form of the invention, an intermediate panel is interposed between the top portion and the skirt, with the intermediate panel dimensioned of a thickness substantially equal to the thickness of the spring and/or box spring of the bed in connection with which the dust ruffle is used. In accordance with the invention, a retaining panel substantially equal in height to the height of a conventional box spring which generally ranges between 3" and 10" in thickness is provided along the head portion of the top portion. This retaining panel preferably is slightly shorter than the head of the bed and is elastically secured by elastic thread and/or a shirring stitch along at least the vertical seams between the retaining panel and the skirt or side panel to provide for snug engagement between the dust ruffle and spring or box spring.

In use, the above described dust ruffle is secured in position on a bed by positioning the top portion over the top surface of the bed spring. It is contemplated that such dust ruffles will find maximum utilization in connection with beds having a box spring on a bed frame, and it is contemplated that the top portion will be sandwiched between the conventionally employed mattress and box spring. As a result of the elasticized seams, and the retaining panel extending down from the head of the top portion between the skirt, elasticized fitted engagement of the dust panel with respect to the bed is obtained minimizing likelihood of shifting of the dust ruffle after positioning.

A feature of the invention resides in the utilization of a simple retaining panel elastically joined to the conventionally employed components of a dust ruffle to provide fitted engagement and positioning of the dust ruffle on the bed.

Another feature of the invention resides in the fact that by the utilization of the retaining panel to provide desired fit, the material normally employed in the top portion of the dust ruffle to extend between the mattress and box spring can be substantially reduced.

BRIEF DESCRIPTION OF THE DRAWINGS

The specific details of a preferred embodiment of the invention, and their mode of functioning and the manner and process of making and using the invention will be particularly pointed out in clear, concise and exact terms in conjunction with the accompanying drawings wherein.

DETAILED DESCRIPTION OF PREFERRED EMBODIMENT OF THE INVENTION

Figure 1:
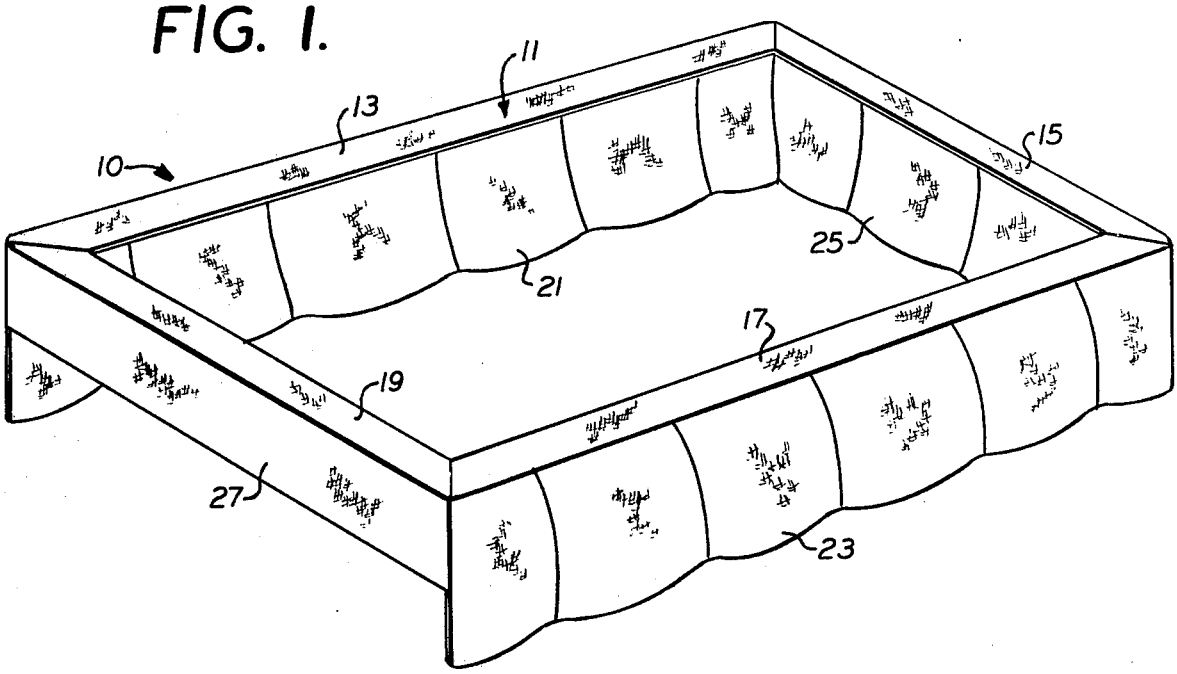
FIG. 1 is a perspective view of one form of dust ruffle made in accordance with the teachings of the invention viewed from the head end with the parts of the dust ruffle shown in orientation as positioned on a bed.

Referring now more particularly to the drawings, the dust ruffle 10 as seen in FIG. 1 is formed with a top portion 11 dimensioned to extend over the bed frame in connection with which the dust ruffle 10 is to be employed. In the embodiment of the invention illustrated in FIG. 1, the top portion 11 is formed of four strips respectively labeled 13, 15, 17 and 19. Strips 13 and 17 extend along opposed sides of the bed, while strip 15 extends along the foot of the bed, and strip 19 extends along the head of the bed. These strips are of a length such as to extend across the respective sides, foot, and head end of the bed over which that strip is arranged, and the strips are of a width such that they may readily be sandwiched between the conventionally employed spring or box spring of the conventional bed in connection with which the dust ruffle 10 is to be employed. A width of between 3 and 12 inches for the strips will be found to provide adequate securement of the dust ruffle with respect to the bed.

Vertically extending portions depending from the sides of the top portion are formed by side skirts or flounces 21 and 23 respectively, which extend along the full length of the side of the bed. A similar foot skirt or flounce 25 extends along the foot of the bed.

In accordance with the invention, in addition to the above described side and foot skirts or flounces, the vertically extending portions of the dust ruffle also comprise, a retaining panel 27 extending along the head of the top portion. Retaining panel 27 is preferably of a length slightly shorter than the length of the head of the spring or box spring of the head of the bed, and is of a height equal to the width of the spring or box spring in connection with which the dust ruffle is employed. Heights of between three and twelve inches for this retaining panel are adequate.

The skirt or flounces 21, 23 and 25 extend from the floor, or a point slightly above the floor to the top portion 11.

It is preferred that all seams joining the flounces, top and retaining panel be elasticized and that the lengths of the respective sides and foot of the bed in connection with which the bed ruffle 10 is employed. At least the retaining panel 27 should be made slightly shorter in length than the length of the head end of the spring or box spring, and at least the vertical seam between the ends of the retaining panel and the ends of the side flounces 21 and 23 abutting said retaining panel, along the spring or box spring are joined by elastic thread and/or shirred stitching.

Figure 2:
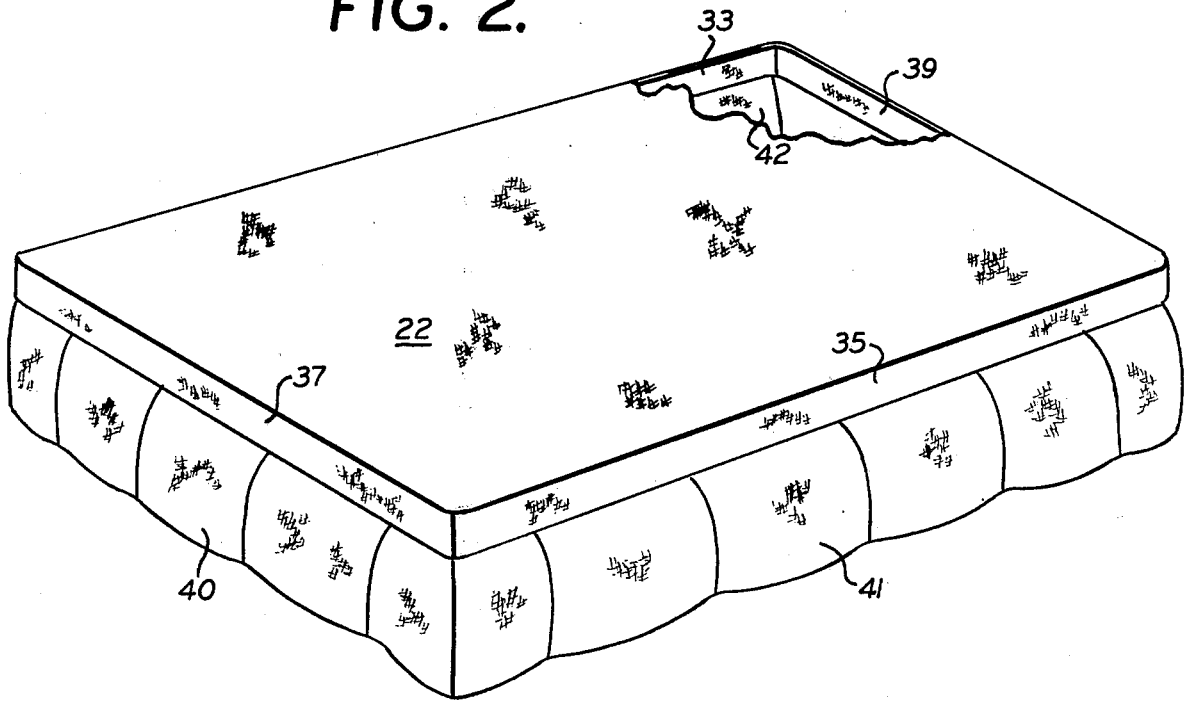
FIG. 2 is a perspective view of another embodiment of the invention showing the dust ruffle with the parts of the ruffle oriented as in position on a bed viewed from the foot end with parts broken away at the head end to illustrate the retaining panel.

In the embodiment of the invention illustrated in FIG. 2, the top portion 22 is formed preferably of a textile fabric, but is obviously subject to formation of a variety of flexible sheet materials, such as sheet plastics, or the like, and is dimensioned to extend over the top of a bed frame or box spring in connection with which the dust ruffle is to be employed. In this embodiment of the invention, side panels 33 and 35, and a foot panel 37, along with a retaining head panel 39 are provided between the top portion 22 and side skirts or flounces 41 and 42 and foot skirt of flounce 40. Panels 33, 35, 37, and 39 are preferably formed of a length slightly less than the length of the respective sides, foot and head of the bed in connection with which the dust ruffle is to be employed and are formed preferably of a textile fabric such as woven cotton, percale, or the like sheeting materials. These panels are of a height substantially equal to the height of the box spring or bed frame in connection with which the dust ruffle is employed, and range between three and twelve inches. The vertical seams between the panels 33, 35, 37 and 39 are preferably joined by elastic thread and/or shirred stitching to provide an elastic seam.

Secured to the lower edge of the side panels 33 and 35, and the foot panel 37, are skirt or flounces 40, 41 and 42, respectively. No skirt or flounce being necessary at the head end of the dust ruffle which is usually either against the wall or concealed by the headboard of the conventional bed.

OPERATION

In use, the aforedescribed bed ruffles, whether in the form shown in FIG. 1, or the form shown in FIG. 2, serve to provide a dust ruffle which may readily be positioned on the conventional bed and held in secure position by virtue of the elasticized engagement of the dust ruffle components with the box spring or bed frame of the bed in connection with which the dust ruffle is employed.

The dust ruffle of the types shown in FIGS. 1 and 2 is fabricated, utilizing conventional sewing techniques by cutting the aforedescribed components preferably of a woven textile fabric or any one of a variety of flexible sheet materials such as would be deemed suitable for the formation of the dust ruffle. The components are then assembled as above described utilizing conventional sewing techniques and preferably employing an elasticized thread and/or a shirred stitch to obtain desired elasticity, particularly along the vertical joints between vertically extending components of the dust ruffle, along the point of contact of these vertically extending components with the bed frame or box spring, e.g., between the skirt or flounces and the retaining panel of the FIG. 1 embodiment, or between the side, foot and retaining panels of the FIG. 2 embodiment, with the elasticized stitching providing elastic engagement between the dust ruffle and the bed frame or box spring.

The above disclosure has been given by way of illustration and elucidation and not by way of limitation, and it is desired to protect all embodiments of the herein disclosed inventive concept within the scope of the appended claims.

What is claimed is:

1. A dust ruffle for use over a bed frame to provide a desired enclosure for the lower portion of the bed, said dust ruffle comprising:

a top portion dimensioned to overlie the top of the bed frame;

vertically extending portions extending along the sides and foot and head of the bed;

at least the vertically extending portion extending along the sides extending down to a point touching or slightly above the floor;

at least one of said vertically extending portions being dimensioned to be slightly smaller than the length of the sides and foot of the bed;

and a retaining panel along the head of the bed extending vertically from the top portion and dimensioned to be slightly shorter than the length of the head of the bed, said retaining panel and vertically extending portions being secured together along their vertical lines of juncture by elasticized means, at least along the upper portion thereof adjacent the top panel and surrounding the bed frame or box mattress in connection with which dust ruffle is to be employed, whereby there will be an elasticized inter-engagement between the dust ruffle and the bed frame or box mattress.

2. A dust ruffle as in claim 1, in which said vertically extending portion comprises a skirt.

3. A dust ruffle as in claim 1, in which said top portion comprises a sheet of textile material.

4. A dust ruffle as in claim 1, in which said top portion comprises elongate strips of a length slightly less than that of the sides, foot, and head of the bed in connection with which the dust ruffle is employed, with said strips joined together to form a rectangular frame overlying the edge of the bed.

5. A dust ruffle as in claim 1, in which said vertically extending portions comprise side and foot strips dimensioned to extend along the sides and foot of the bed, and a retaining headstrip, with said strips of a length slightly less than the sides, foot and head respectively, and of a width between three and twelve inches, with said strips elastically joined along their vertical edges to each other to form a frame enclosure for the sides of the bed frame or box spring.

* * * * *